US006719177B2

(12) United States Patent
Manini

(10) Patent No.: US 6,719,177 B2
(45) Date of Patent: Apr. 13, 2004

(54) METHOD AND APPARATUS FOR LONGITUDINAL ORIENTATION OF HOSIERY ARTICLES

(75) Inventor: Benito Manini, Florence (IT)

(73) Assignee: Matec S.p.A. (IT)

( * ) Notice: Subject to any disclaimer, the term of this patent is extended or adjusted under 35 U.S.C. 154(b) by 0 days.

(21) Appl. No.: 10/104,753

(22) Filed: Mar. 21, 2002

(65) Prior Publication Data

US 2002/0148864 A1 Oct. 17, 2002

(30) Foreign Application Priority Data

Mar. 21, 2001 (IT) ..... PI2001A0021

(51) Int. Cl.[7] ..... D06C 5/00
(52) U.S. Cl. ..... 223/75
(58) Field of Search ..... 223/75, 76, 77

(56) References Cited

U.S. PATENT DOCUMENTS 3,704,565 A * 12/1972 Glaze, Jr. ..... 53/429
5,769,286 A * 6/1998 Conti ..... 223/75
5,904,279 A * 5/1999 Bertram et al. ..... 223/112

* cited by examiner

*Primary Examiner*—John J. Calvert
*Assistant Examiner*—James G Smith
(74) *Attorney, Agent, or Firm*—The Bilicki Law Firm, PC

(57) ABSTRACT

A method for longitudinal orientation of tubular knitted elements such as socks (2), knee socks or the like, wherein a stretching step of the sock (2) is provided in a duct (3) of orientation with its two ends aligned longitudinally. Then, the position of an end that is either a tip portion (2') or a band portion is detected by means of sensors (13). At the detecting step the sock (2) is conveyed in the duct (3) in a direction according to which the position is known of the band portion with respect to the tip portion (2'), whereby before the introduction of the sock (2) in a loading duct (3) a step is provided of inversion of the sock (2) if the band portion is not oriented in the chosen direction, or a step of rejection. The sock (2) is selectively conveyed in the duct (3) by an air flow in either direction. Also the preliminary stretching step of the sock (2) is carried out by an air flow after preliminary grasping first end thereof, whereby the second end engages the sensors. A mechanical dragging is provided (12) of the sock starting from its second end through the sensors (13), which scan at least part of the first end.

19 Claims, 8 Drawing Sheets

METHOD AND APPARATUS FOR LONGITUDINAL ORIENTATION OF HOSIERY ARTICLES

FIELD OF THE INVENTION

The present invention refers to a method for longitudinal orientation of hosiery articles such as socks, knee socks or similar for their successive loading on supports for their handling.

Furthermore the invention relates to an apparatus that carries out this method.

BACKGROUND OF THE INVENTION

In the following description, reference is made to socks, being it clear that the same method can be extended to knee socks and other hosiery articles.

In an automatic production cycle, before that a sock reaches the final packaging, it must follow a path with various working steps.

Usually, at the beginning the sock is picked up automatically or manually from a container and is then subject to intermediate steps that can provide seaming, steaming, up to the final packaging.

For the automatic handling of socks supports are used that are elongated bodies, on which each sock is put, that orient automatically the sock according to a plane of steaming or of seam. For loading socks onto the supports for their handling automatic conveyors are used operated by air currents that drag the socks from a pick up position at the container and load them in turn on a handling support that is present in a loading station.

For loading the sock, the position of the band portion and of the tip portion with respect to the supports must be known. Only in this way the band portion of the sock can be found and manipulated by mechanical means that open it and convey it towards the handling support.

Automatic loading systems exist that pick up socks randomly oriented from a container, that separate them from one another and stretch them by means of air currents. However, such systems do not allow to detect the position of the band portion and of the tip portion with respect to a conveying direction. This needs that an operator controls singularly stretched socks and operates an inversion of the orientation for all those socks for which the band portion and tip portion are arranged in a wrong direction.

SUMMARY OF THE INVENTION

It is therefore object of the present invention to provide a method for longitudinal orientation of socks, knee socks or similar that operates in a completely automatic way.

It is, furthermore, an object of the invention to provide an automatic apparatus that carries out this method.

According to the invention, the method for longitudinal orientation provides the steps of:

- preliminarily stretching the sock in an orienting duct, whereby the sock is arranged in the duct with its two ends aligned longitudinally;
- detecting by means of sensors the position of an end that is either a tip portion or a band portion;
- after the detecting step, conveying the sock in the duct in a direction according to which the position is known of the band portion with respect to the tip portion, whereby before the introduction of the sock in a loading duct a step is provided of inversion of the sock if the band portion is not oriented in the chosen direction, or a step of rejection.

Preferably, for conveying the sock an air flow is selectively operated in the duct of orientation, whereby the sock proceeds in the duct in either one or the other direction and is then deviated into a loading duct so that it is conveyed in the loading duct with band portion and tip portion oriented in a predetermined way by the sensor means.

The preliminary stretching step of the sock can be carried out by means of an air flow after preliminary grasping a first end thereof, whereby the second end engages the sensor means.

Preferably, for carrying out the detecting step a mechanical dragging step is provided starting from its second end through the sensors scanning at least a part of the first end thereof.

In a possible embodiment the sensors carry out contemporaneously a scanning step of the sock upstream of the dragging means and downstream of the dragging means, whereby the profiles can be at the same time measured of the first and second end and a comparison between them is made.

Preferably, after the preliminary stretching step the second end of the sock extends between dragging means, the latter pinching the second end and dragging the sock after that the air flow has stopped, the first end being left free and the sensor means scanning the sock in the portion set between the first and second end.

Advantageously, for a correct scanning of the sock, the sock is pressed between the sensor means during the dragging, for stretching any possible folds and improving the scanning conditions.

In a possible embodiment, the sock after the preliminary stretching step moves substantially in a plane, at least a portion of the sock being scanned by the sensors orthogonally to the plane, whereby the sensors recognize the top plan profile of the tip portion or of the band portion.

Alternatively, the sock after the preliminary stretching step moves substantially in a plane and at least a portion of the sock is scanned by the sensors parallel to the plane, whereby the sensors recognize different heights of the side profile of the tip portion or of the band portion.

According to another aspect of the invention, an apparatus for longitudinal orientation of a sock comprises:

- a duct of orientation wherein the sock is present with its two ends aligned longitudinally,
- sensor means for scanning the profile of the sock at an end and determining whether it is a tip portion or a band portion,
- means for creating selectively in the duct of orientation an air flow that drags the sock in a predetermined way and brings it in a loading duct,
- means for deviating the sock so that it enters the loading duct with tip portion and band portion oriented in a predetermined way.

Preferably, mechanical dragging means of the sock are also provided along the duct of orientation and through the sensor means, which detect the profile of at least a part of the sock at the passage controlled by the dragging means.

The dragging means can comprise at least two dragging rollers that pinch the sock and convey it so that at least a portion thereof passes through the sensor means.

In a possible embodiment, the sensor means are grouped as first sensors upstream of the dragging means and seconds sensors downstream of the dragging means, whereby the profiles can be at the same time measured of the first and second end and a comparison between them is made.

Preferably, the sensor means comprise a head that pushes the sock against a counter-surface belonging to the duct, whereby the sock is dragged between the head and the counter-surface for stretching any possible folds and to allow a correct detecting step of its profile.

In a preferred embodiment, means are provided for stretching the sock in the duct comprising:

means for grasping a first end thereof leaving the second end free, means for creating an air flow from the first to the second end;

means for blocking the dragging means against the second end stretched by the air flow, the dragging means dragging the sock after that the air flow has stopped, the first end being left free at the sensor means and at least a part of the sock crossing the sensor means.

Preferably, in the duct of orientation two grids are provided movable between a open position and a closed position, at each grid grasping means being provided, the sensor means and the dragging means being arranged between said two grids.

The sensor means comprise advantageously an array of sensors with a density that allows a sufficient definition of the contour of the end of the sock. They can be chosen among: optical, mechanical, pneumatics, electrical sensors.

BRIEF DESCRIPTION OF THE DRAWINGS

Further characteristics of the method and of the device for automatic longitudinal orientation according to the present invention will be made clearer with the following description of an embodiment thereof, exemplifying but not limitative, with reference to the attached drawings, wherein:

FIGS. 1A to 6A show a top plan view of the diagrammatical view of FIGS. 1 to 6 in the respective operative steps;

DESCRIPTION OF THE PREFERRED EMBODIMENT

Figure 1:
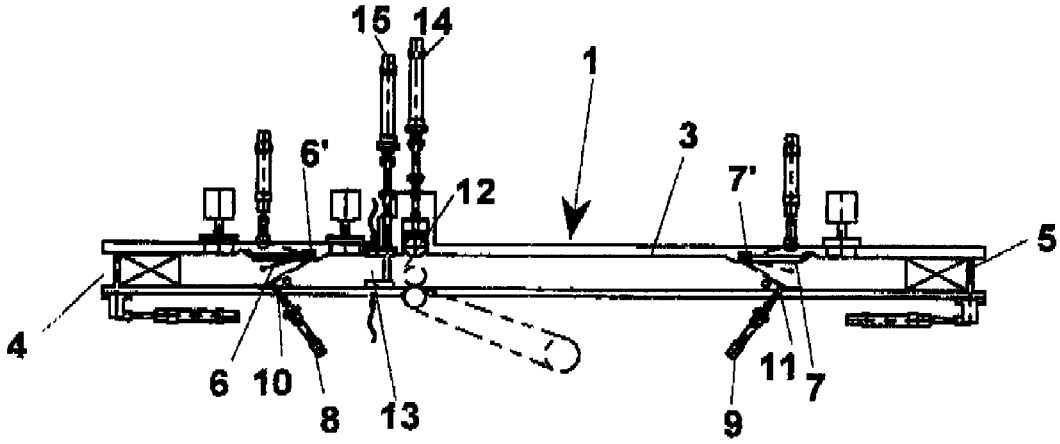
FIGS. 1 to 6 show a diagrammatical longitudinal sectional view of a duct according to the invention for orientation of a sock in various steps of the orienting method.
Figure 1A:
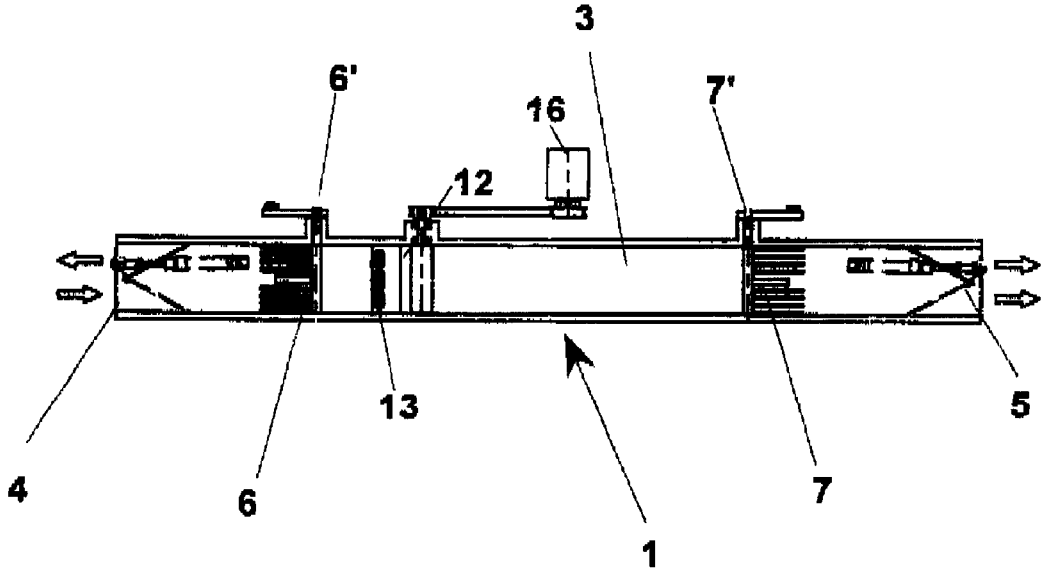

For the longitudinal orientation of a sock 2 an apparatus 1 is provided shown diagrammatically in FIGS. 1 and 1A. It comprises a duct 3 having a first mouth 4 and a second mouth 5 that have valves for allowing in the duct 3 air currents that are directed in either directions.

The duct 3 has a first grid 6 and a second grid 7 rotatable with respect to pins 6' and 7'.

At the grids 6 and 7 devices 8 and 9 are located having grasping elements 10 and 11, having oblique actuators, for holding an end of the socks.

A dragging device 12 is provided having pinch-rollers associated to a device of detection 13 of the profile of the socks. The dragging device 12 can be lowered or raised by means of a piston 14, whereas the device of detection 13 can be lowered or raised by means of a piston 15.

Figure 8:
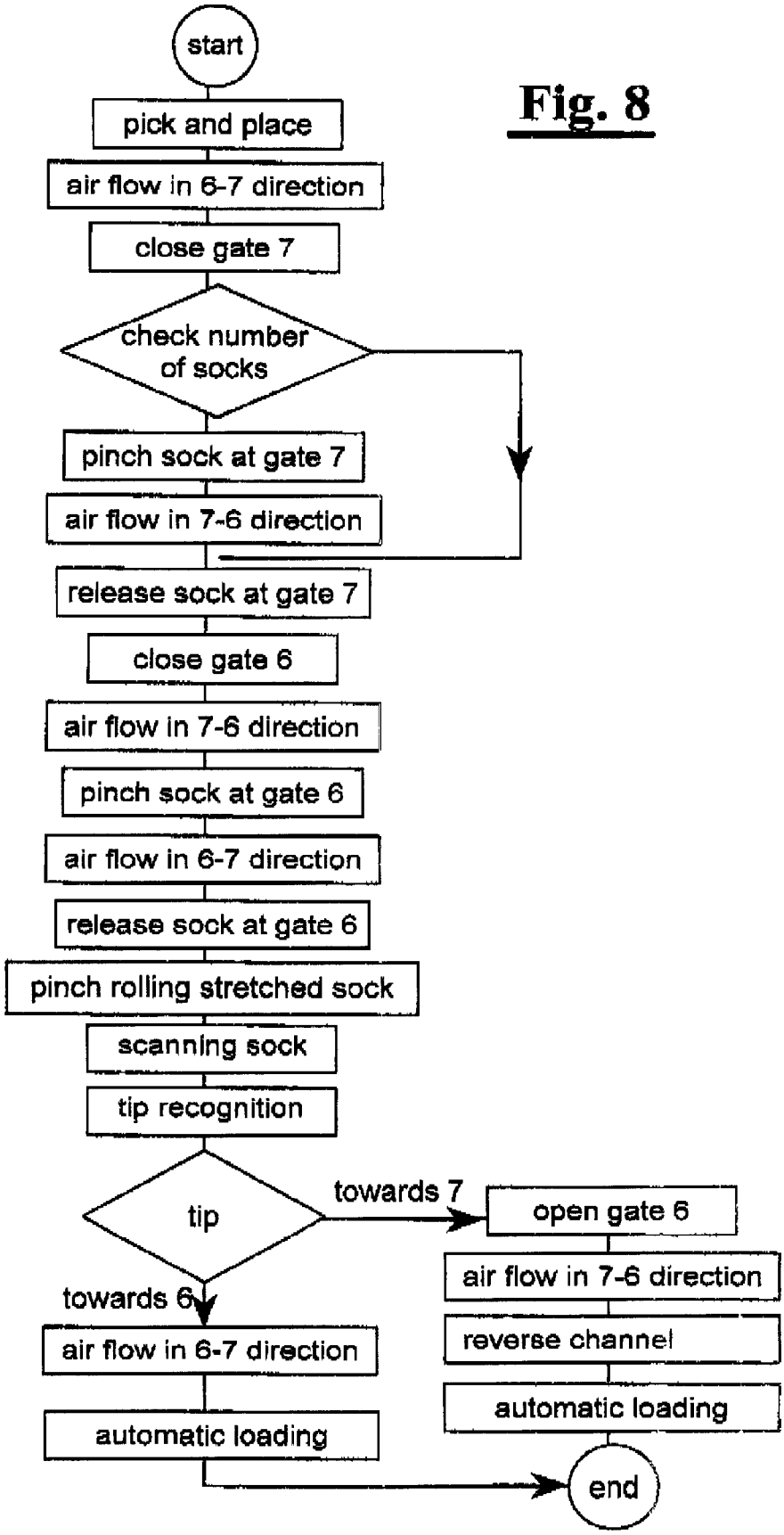
FIG. 8 shows a flow-sheet of the scanning, orienting operations of the sock and for feeding it correctly to the loading unit on a finishing machine.

The process of longitudinal orientation begins with picking up sock 2, for example by a sucker from a container (not shown in the figure) and its introduction in a duct 3. The various steps are summarized also in the diagram of FIG. 8.

Figure 2:
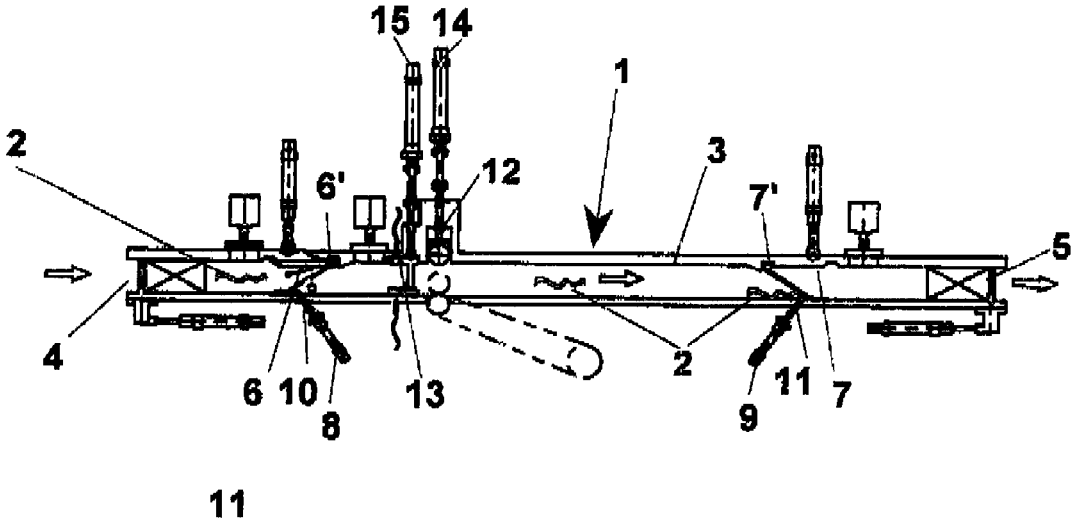
Figure 2A:
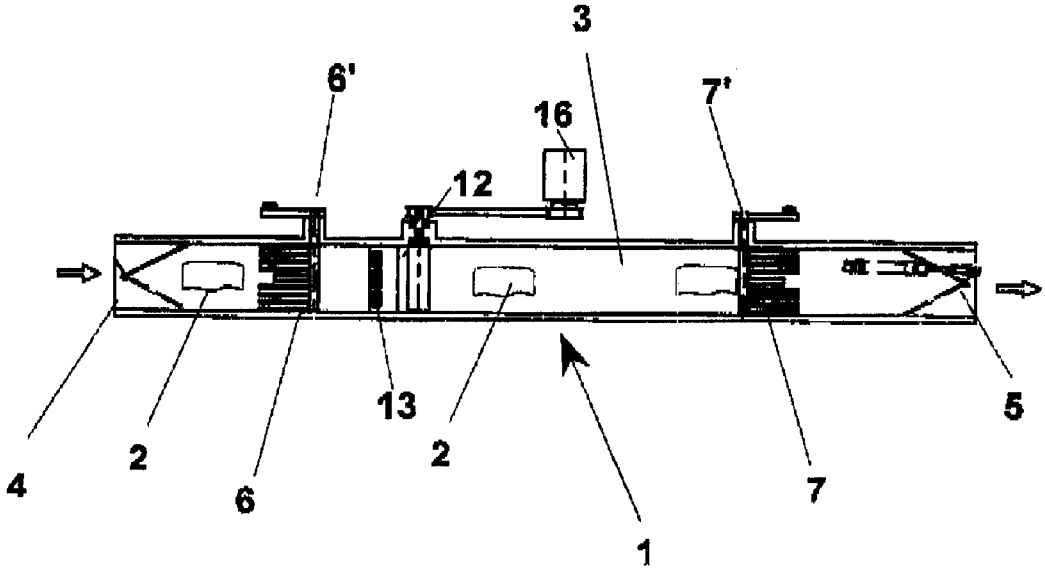
Figure 3:
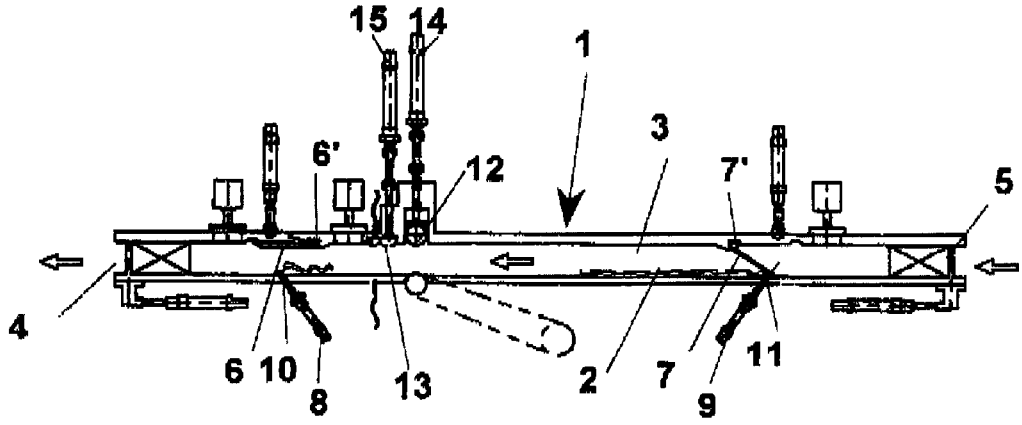
Figure 3A:
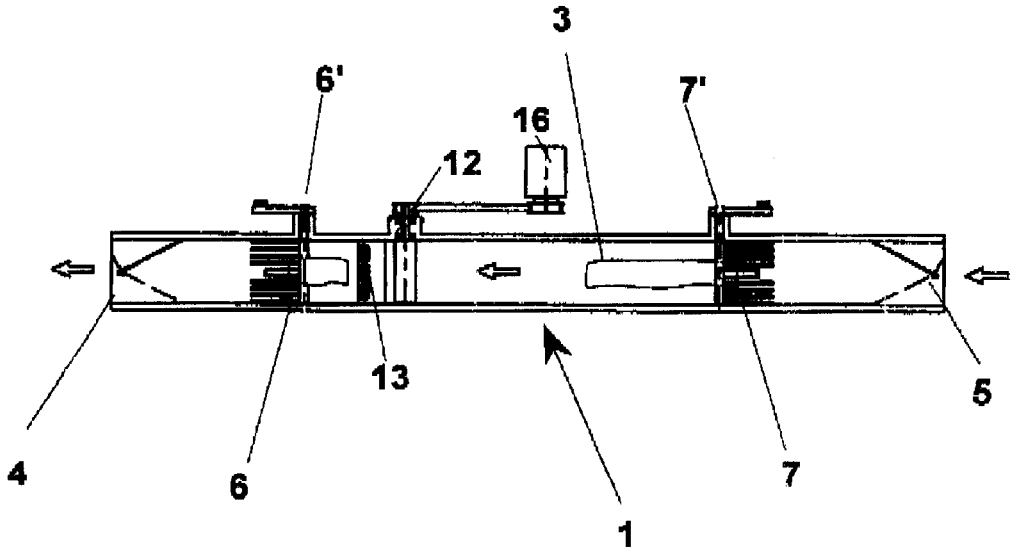

The socks that enter in the duct 3 by means of an air flow from grid 6 to grid 7, then hit against the grid 7 that is in closed position (see FIGS. 2 and 2A). Device 9 moves grasping element 11 in order to grasp one sock. In presence of more socks, that can be detected by means of optical sensors that consider the volume occupied by the mass of socks, an air jet is delivered in a direction of the first grid 6, that is in raised position, so that all the further socks 2 are rejected through the duct 3 (see FIGS. 3 and 3A).

Figure 4:
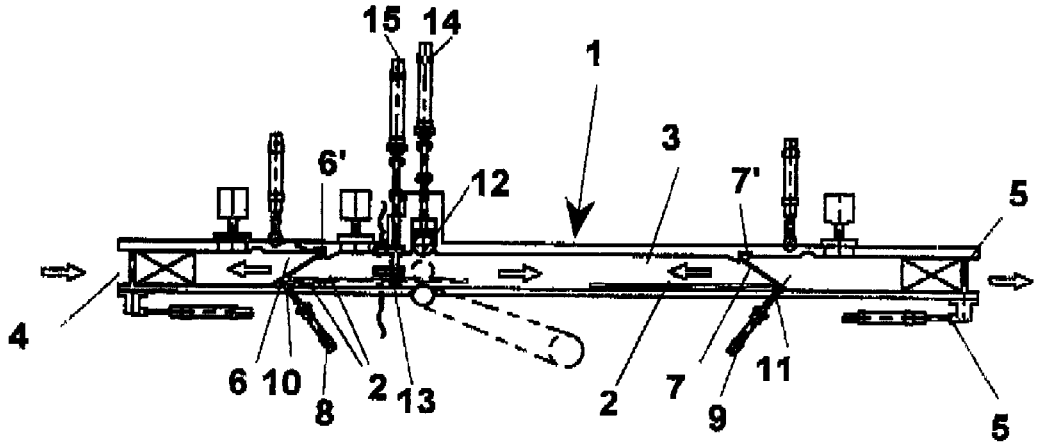
Figure 4A:
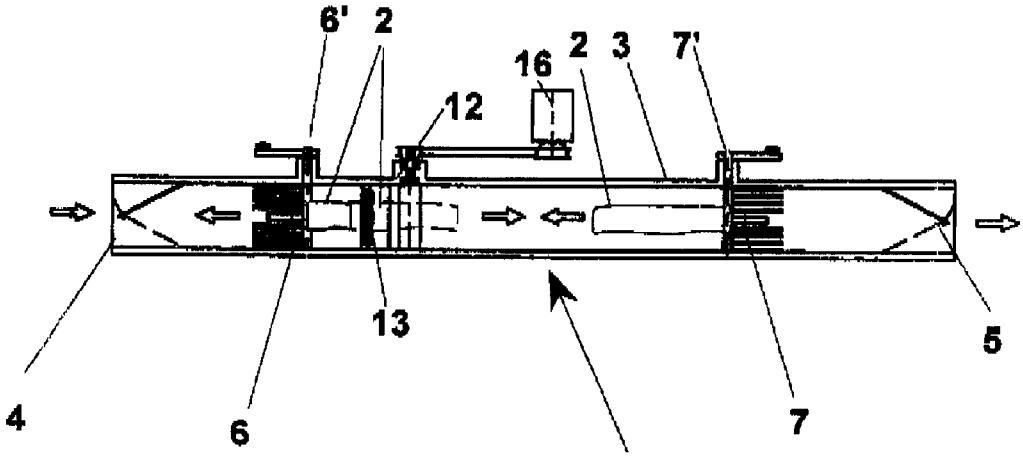
Figure 5:
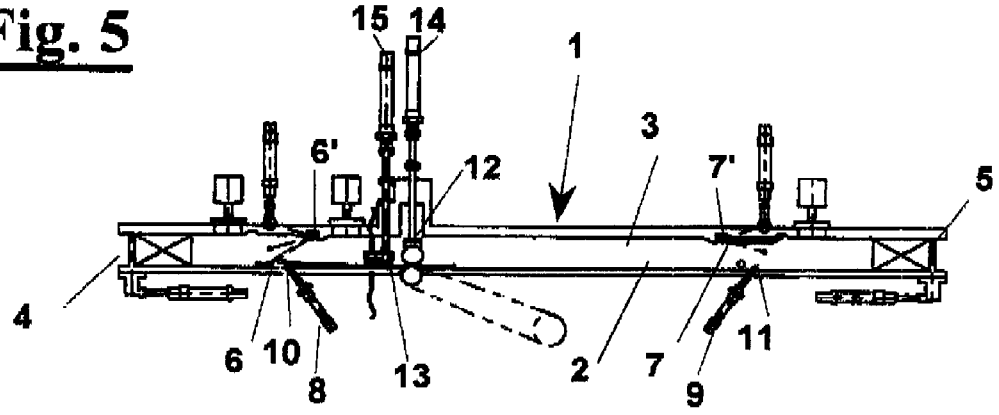
Figure 5A:
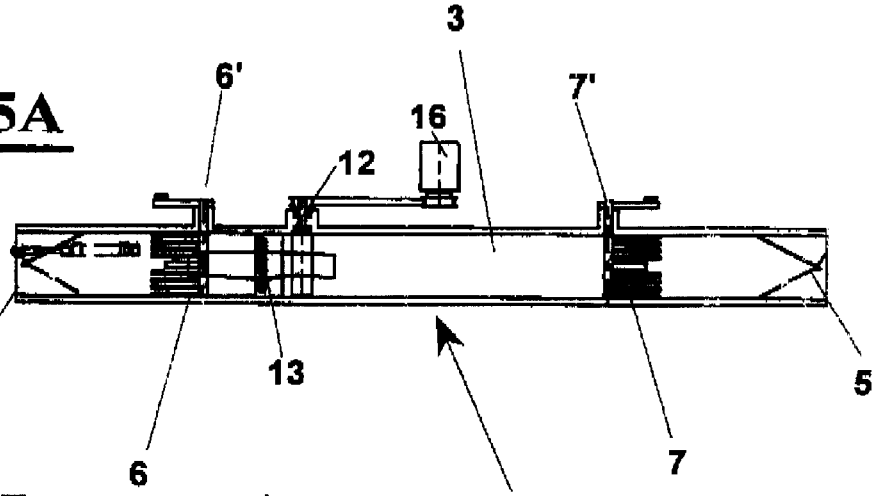
Figure 7:
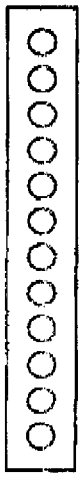
FIGS. 7, 7A and 7B show a possible scanning view of an end of the sock.
Figure 7A:
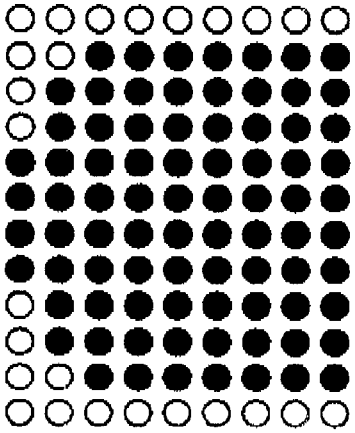
Figure 7B:
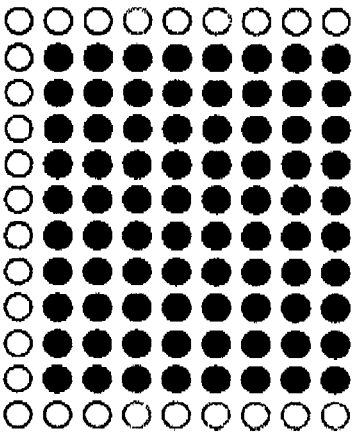

With reference to FIGS. 4 and 4A, when the socks in excess have left the duct 3, the first grid 6 is closed and the sock 2 previously grasped is released and hits against first grid 6. Then, the sock 2 is grasped by the other grasping device 8 and the air flow is inverted, i.e. from grid 6 towards grid 7, whereby the sock 2 is stretched longitudinally. For assuring the stretching condition, the operations now described between the two grids can be repeated, so that the sock is effectively stretched and is not grasped by device 8 in a central zone.

When sock 2 is still being grasped, the dragging means 12 are lowered, whereby the sock 2 is dragged in the direction towards second grid 7, whereas the air flow stops momentarily, and contemporaneously with dragging means 12 the sensor means 13 carry out a scanning step of the sock 2 (see FIGS. 5, 5A, 7, 7A, 7B).

Figure 6:
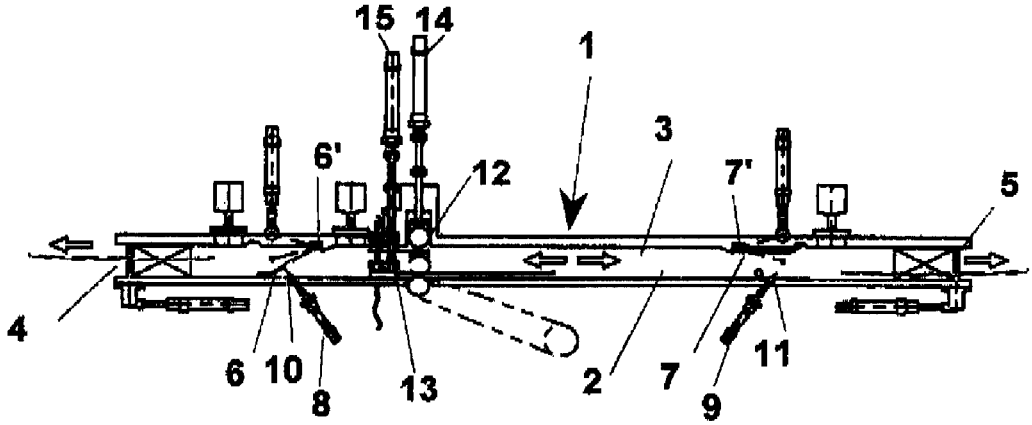
Figure 6A:
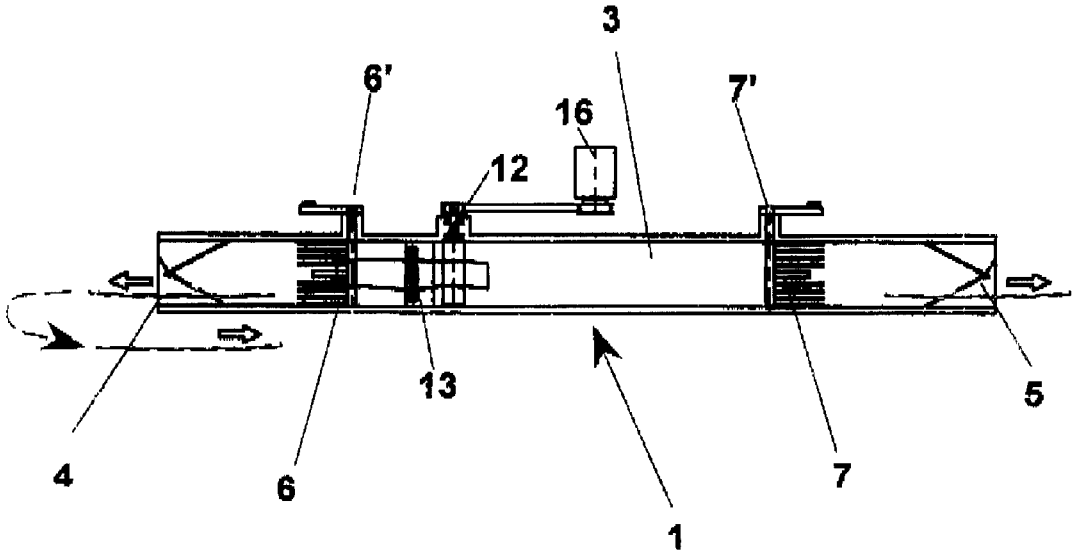

To assure that sock 2 is oriented correctly and can then proceed for successive steps of the production cycle, it is necessary that tip portion 2' (see FIG. 7A) is arranged according to the direction of second grid 7. In other words, the sensors 13 must detect the presence of the portion 2' from its contour oriented towards grid 6, this meaning that the band portion is oriented correctly towards grid 7 (see FIGS. 6 and 6A).

In this case, second grid 7 opens and under an air flow directed from grid 6 to grid 7 the sock is pushed away from duct 3, towards a loading station where steaming forms or handling forms are present. Otherwise, sock 2 is pushed in an opposite direction, passes back through mouth 4, and enters an inversion duct that brings it with the band portion oriented forward towards the loading station.

Figure 9:
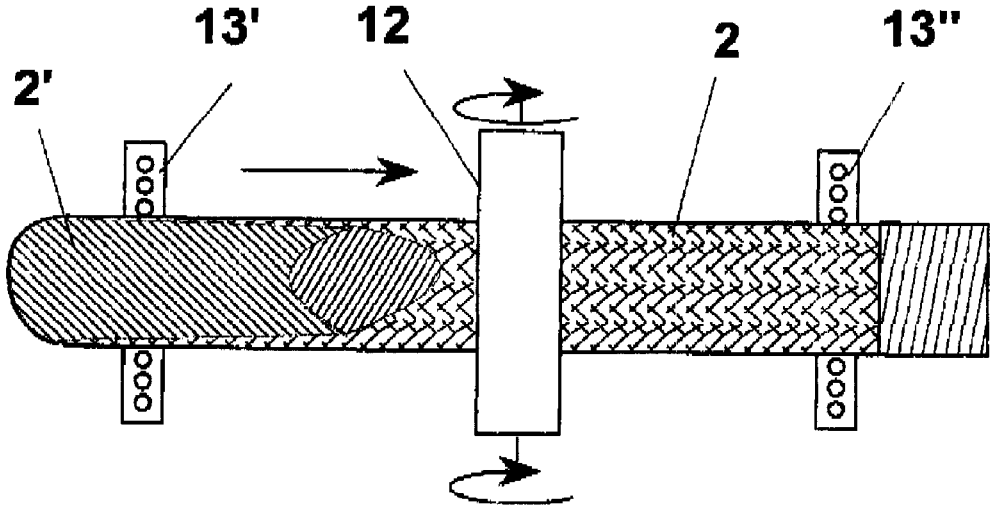
FIG. 9 shows an embodiment of tile invention wherein two array of sensors are provided upstream and downstream of the dragging rollers, for allowing a comparison between the scanning diagram of the tip portion and of the band portion.

With reference to FIG. 9, according to a different embodiment of the invention, two arrays of sensors 13 and 13' are provided respectively upstream and downstream of the dragging rollers 12, for allowing a comparison between the scanned shape of the tip portion 2' and of the band portion. This way, it is possible to orient socks that have only a slight difference between tip portion and band portion. The double scanning increases the detection precision when the sock tends to traverse obliquely in the duct.

Figure 10:
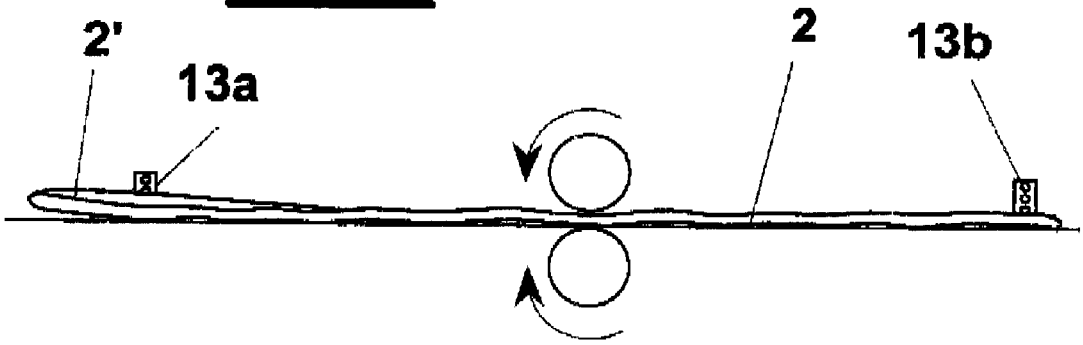
FIG. 10 shows a further embodiment of the invention wherein the sensors operate according to directions parallel to the plane of the sock, for scanning different heights of the side profile of the tip portion or of the band portion.

As shown in FIG. 10, according to a further embodiment of the invention, sensors 13*a* and 13*b* can be provided that carrying out a scanning step according to directions parallel to the plane of sock 2 for detecting different heights of the side profile of the tip portion 2' or of the band portion. In fact, in many types of socks the tip portion, not yet steamed, tends to fold owing to the different tension of the knitted zones of the tip. This difference can be detected alternatively or in addition to the solution previously described, wherein the sensors are oriented in a direction orthogonal to the plane of the sock.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. A method for longitudinal orientation of a tubular knitted element, said tubular element selected from a group comprised of socks and knee socks, said tubular element having two respective ends as a tip portion (2') and a band portion, comprising the steps of:

preliminarily stretching the tubular element (2) in a duct (3) of orientation, whereby the tubular element (2) is present in the duct (3) of orientation with its two ends aligned longitudinally;

detecting by means of sensors (13) the position of an end that is either a tip portion (2') or a band portion;

after the detecting step, conveying the tubular element (2) in the duct (3) in a direction according to which the position is known of the band portion with respect to the tip portion (2'), whereby before the introduction of the tubular element (2) in a loading duct (3) a step is provided of inversion of the tubular element (2) if the band portion is not oriented in the chosen direction.

2. Method according to claim 1, wherein said method further includes, when a plurality of said tubular elements are present with said duct, rejecting any of said plurality of said tubular elements not held by a grasping device.

3. Method according to claim 1, wherein for conveying the tubular element (2) an air flow is selectively sent in the duct (3) of orientation whereby the tubular element (2) proceeds in the duct (3) in either one or the other direction and is then deviated into a loading duct (3) so that it is conveyed in the loading duct (3) with band portion and tip portion (2') oriented in a predetermined way by said sensor means.

4. Method according to claim 1, wherein the preliminary stretching step of the tubular element (2) is carried out by means of an air flow after preliminarily grasping a first end thereof, whereby the second end engages said sensor means.

5. Method according to claim 1, wherein for carrying out said detecting step a mechanical dragging step is provided (12) starting from its second end through said sensors (13) that carry out a scanning of at least part of the first end thereof.

6. Method according to claim 1, wherein said sensors carry out a contemporaneous scanning of said tubular element upstream and downstream of said dragging means (12), whereby the profiles can be at the same time detected of said first and second end and a comparison between them is made.

7. Method according to claim 5, wherein after said preliminary stretching step the tubular element extends with said second end between dragging means (12), the latter pinching said second end and dragging the tubular element (2) after that the air flow has stopped, the first end being left free and the sensor means (13) scan the tubular element (2) in the portion set between said first and said second end.

8. Method according to claim 5, wherein for a correct scanning the tubular element (2) is pressed between the sensor means (13) during the dragging step, for stretching any possible folds and improving the scanning conditions.

9. Method according to claim 1, wherein the tubular element (2) after said preliminary stretching step moves substantially in a plane, said sensors (13) scanning at least a portion of said tubular element (2) orthogonally to said plane, whereby said sensors recognize the plan profile of said tip portion (2') or of said band portion.

10. Method according to claim 1, wherein the tubular element (2) after said preliminary stretching step moves substantially in a plane, said sensors (13) scanning at least a portion of said tubular element (2) parallel to said plane, whereby said sensors recognize different heights of the side profile of said tip portion (2') or of said band portion.

11. Apparatus for longitudinal orientation of a sock (2) according to the one of the previous claims, comprising:

a duct (3) of orientation wherein said sock (2) is present with its two ends aligned longitudinally, sensor means (13) for scanning the profile of said sock (2) at one end of said sock (2) and determining whether it is a tip portion (2') or a band portion, means for creating selectively an air flow in said duct (3) of orientation that drags said sock (2) in a predetermined way and brings it in a loading duct (3), means for deviating said sock (2) so that it enters said loading duct (3) with tip portion (2') and band portion oriented in a predetermined way.

12. Apparatus according to claim 11, wherein mechanical dragging means (12) of the sock (2) are also provided along said duct (3) of orientation and through said sensor means (13), the latter detecting the profile of at least one part of said sock (2) at the passage controlled by said dragging means (12).

13. Apparatus according to claim 12, wherein said dragging means (12) comprise at least two dragging rollers that pinch said sock (2) and convey it so that at least a portion thereof passes through said sensor means (13).

14. Apparatus according to claim 12, wherein said sensor means are grouped as first sensors upstream of said dragging means (12) and second sensors downstream said dragging means (12), whereby the profiles can be at the same time measured of said first and second end and a comparison between them is made.

15. Apparatus according to claim 13, wherein said sensor means (13) comprise a head that pushes said sock (2) against a counter-surface belonging to said duct (3), whereby said sock (2) is dragged between said head and said counter-surface for stretching any possible folds and for allowing a correct detection of its profile.

16. Apparatus according to claim 13, wherein means are provided for stretching the sock (2) in said duct (3) comprising:

means for grasping a first end thereof leaving the second end free, means for creating an air flow from the first to the second end;

means for blocking said dragging means (12) against said second end stretched by said air flow, said dragging means (12) dragging the sock (2) after the air flow has stopped, the first end being left free, the sensor means (13) scanning at least one part of said sock that crosses them.

17. Apparatus according to claim 11, wherein in said duct (3) of orientation two grids are provided (6,7) movable between an open position and a closed position, at each grid (6,7) grasping means being provided (8,9), the sensor means (13) and the dragging means (12) being arranged between said two grids (6,7).

18. Apparatus according to claim 11, wherein said sensor means (13) comprise an array of sensors (13) with a density that allows a sufficient definition of the contour of at least a portion of the sock (2).

19. Apparatus according to claim 11, wherein said sensor means (13) are chosen among: optical sensors (13), mechanical sensors (13), pneumatic sensors (13) electrical sensors (13).

* * * * *

UNITED STATES PATENT AND TRADEMARK OFFICE

CERTIFICATE OF CORRECTION

PATENT NO. : 6,719,177 B2
DATED : April 13, 2004
INVENTOR(S) : Manini

It is certified that error appears in the above-identified patent and that said Letters Patent is hereby corrected as shown below:

Title page,
Item [57], ABSTRACT,
Line 14, "Also the" should read -- Also, the --

Column 6,
Line 4, "claim 5" should read -- claim 6 --

Signed and Sealed this

Eighth Day of June, 2004

JON W. DUDAS
*Acting Director of the United States Patent and Trademark Office*